United States Patent [19]

Kadlub

[11] 4,155,137

[45] May 22, 1979

[54] WATER POWERED BRUSH METHOD AND APPARATUS

[76] Inventor: Thomas E. Kadlub, 618 10th St. E., Williston, N. Dak. 58801

[21] Appl. No.: 828,647

[22] Filed: Aug. 29, 1977

[51] Int. Cl.[2] ..... A46B 13/06

[52] U.S. Cl. ..... 15/4; 4/158; 15/29; 128/56; 137/599.1

[58] Field of Search ..... 15/22 R, 23, 24, 28, 15/29, 97 R, 4; 4/158, 184; 128/37, 47, 50, 53, 66, 56; 134/6; 137/599.1

[56] References Cited

U.S. PATENT DOCUMENTS

| | | | |
|---|---|---|---|
| 1,937,597 | 12/1933 | Schmidt | 137/599.1 |
| 2,599,911 | 6/1952 | Haines | 15/29 |
| 2,836,197 | 5/1958 | Johnson | 137/599.1 X |
| 4,043,337 | 8/1977 | Baugher | 128/66 X |

*Primary Examiner*—Edward L. Roberts
*Attorney, Agent, or Firm*—Wilbur A. E. Mitchell

[57] ABSTRACT

A water powered operable appliance method and apparatus in a water main line flow by an off-chute water line from the main line remote from the main line discharge end, and operated by the entire water flow through the off-chute line and then return of said entire water flow by the off-chute line to the main line remote from the main line discharge end, and an optional manually operable shut-off valve associated with the off-chute line adapted for preventing such water flow through the off-chute line on use of the entire water flow through the main line.

5 Claims, 5 Drawing Figures

WATER POWERED BRUSH METHOD AND APPARATUS

This invention pertains to a hydraulic powered turbine brush in a hydraulic line.

More particularly, this invention pertains to a water powered brush method and apparatus operable in a water line, by an off-chute line therefrom by the pressure thereof, and positioned at a point before the water line point of discharge, and without diminishing the water flow discharge therefrom.

Heretofore, as far as known in the use of water powered brushes, a water powered brush has been connected and operated in and by a water line and after the operation of the brush the water motive stream has either been returned to the water source, or the water brush has been at the line discharge point and the water has been discharged through the brush.

Applicant has developed an improved water powered brush method system whereby neither of the heretofore methods are used. His brush is operated by an offset line without interfering with the flow of the water through the main line, where the main line is directed to a given point of discharge such as to a shower head or a hose nozzle or some such use.

Accordingly, Applicant has as a principle object the provision of a water channel offset from a main water channel for operating a water powered brush to utilize the power of the water passing through the offset channel to operate the brush and to return the water to the main channel to permit its ultimate discharge from the main channel discharge outlet point without detracting from the volume of that discharge therefrom.

Another object is the method of providing the steps of an offset water channel from a main water channel to operate a water powered brush by the water flowing through the offset channel and then returning the water from the brush to the main channel for its ultimate flow to the main channel discharge point, and having the offset channel of flexible conduits with the brush secured thereto.

Another object is the provision of an operable valve means at the point of exit of the offset channel from the main channel to control the water flow from the main channel into the offset channel when in one valve position or to close the offset channel to prevent water from entering therein from the main channel when in another valve position.

Other and further objects will be apparent from the following detailed description and explanation of the operation of the preferred embodiment of the invention and from the drawings, in which.

Figure 1:
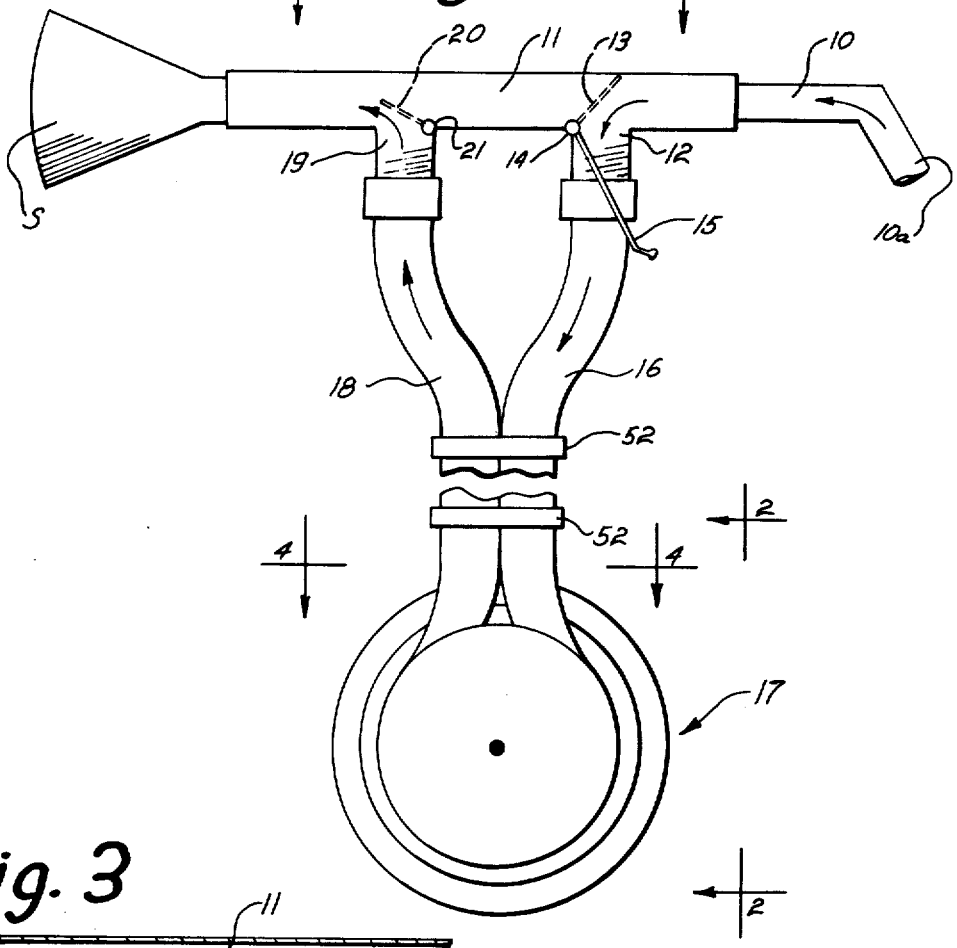
FIG. 1 is a side elevational partial-broken view of my water powered brush as used with a shower bath head.

Referring now to the drawings, in the use of my invention with a conventional shower head pipe 10, I provide a U-shaped pipe extension 11 having two right angular coupler arms 12 and 19. The water source enters the pipe end at 10*a* and flows therein to the left as illustrated. The first, or right as viewed, offset T-coupler 12 opening is provided with an inner manually operated pivoted crank door valve 13, designed to move on its pivot 14 in one position illustrated in full lines of FIG. 3, to completely close the opening 12 thereof, and in another position of pivoted movement of the crank valve 13, illustrated in dotted lines in FIG. 1, to open 12. That crank door valve 13 is at an angle within pipe 11, as illustrated in FIG. 1, to block the flow of the water to the left as illustrated, through 11 and to direct that water flow into the off-chute pipe 12—16 for reason to be explained. A suitable inner notch is provided within 11, not shown, to hold the crank door 13 in the closed valve position shown in FIG. 3, caused by the arm 15 manually moving crank door valve 13 on its pivot 14 into that position there shown.

Figure 3:
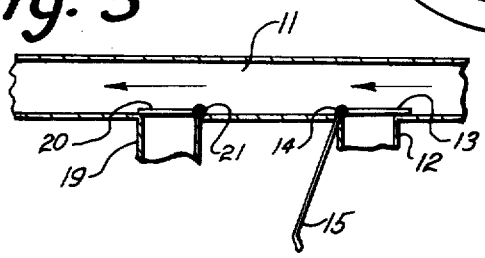
FIG. 3 is a partial vertical cross-sectional view of the upper pipe and valves of FIG. 1, indicated by the number 3—3 of FIG. 1.
Figure 2:
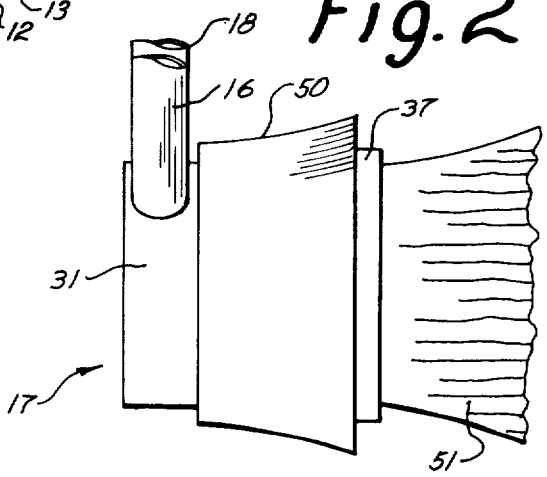
FIG. 2 is a side view of the brush portion thereof.

A flexible water hose 16 is connected to extend the offset T pipe 12 to one end of a conventional turbine housing 31 of a rotary powered brush 17. A return other flexible water hose 18 directs the water from that housing 31 back to the other offset T 19 of the U pipe 11. A spring actuated pivoted door valve 20, normally spiral spring held in the closed position over the opening 19, as shown in FIG. 3, is provided. That spring on valve 20 thereof is a weak spring so as to not interfere with the normal water pressure flow coming thereunder from the rotary brush up through return conduit 18. The return water flow from the brush turbine causes that valve 20 pivoted door to be raised against the spring tension to let the water to be discharged into 11, as indicated by the dotted line position of 20 and the arrow of the water flow of FIG. 1, when the water coming from 10 enters into the water turbine through 12 and 16 as a result of the open position of crank valve 13, as illustrated in FIG. 1. Flutter spring pivot valve 20 is pivoted at 21.

Figure 4:
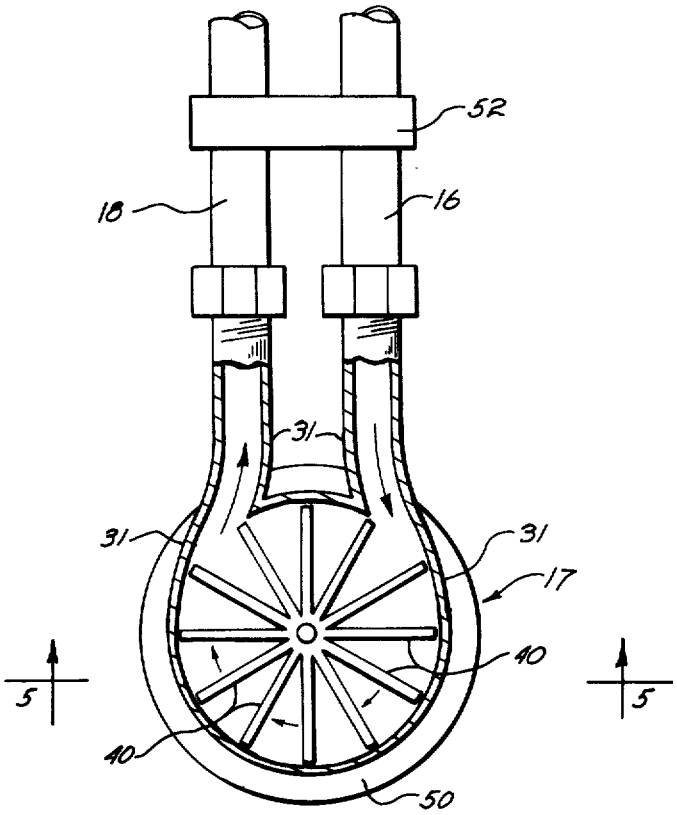
FIG. 4 is a partial cross-section of my water powered brush, taken as indicated by line 4—4 in direction of arrows of FIG. 1.
Figure 5:
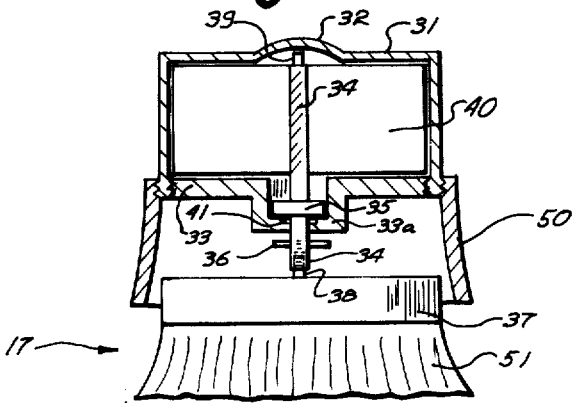
FIG. 5 is a vertical cross-section of my water powered brush taken on line 5—5 of FIG. 4.

My water powered brush is of conventional construction, having the housing 31 for the water turbine brush operable therein with the water entering the turbine by the inlet connection 16, and the water leaving the turbine at the outlet extension 18 causing a rotation of the rotatable paddle wheel 40 thereof in conventional manner, as illustrated in FIG. 4. Housing 31 has an inverted bearing cup 32 to hold the upper reduced end of the rotatable turbine shaft 39 therein, of the rotatable shaft 34. A floor 33 is suitably secured, as by screw-threading into the lower edges of 31, and the floor has a bearing central recess 33*a* designed to receive a bearing collar 35 of shaft 34 therein. The turbine paddle wheel has a shaft 34 and it has the collar bearing 35 as an integral part thereof to ride on recess 33*a*. A packing is provided in 33*a* for the purpose of water seal in conventional manner. A pin 36 is secured in the shaft 34, as illustrated in FIG. 5, for reason of adaptability of removable screw-securement of the brush 37 to the shaft. The brush 37 has a central upper stud 38 screw-threaded and is adapted for removable insert as shown into the lower end of shaft 34, upon manual holding of the shaft by pin 36. This water powered brush is of conventional turbine design.

Conventional water fins or blades 40 substantially fill the space within the housing 31, as shown, secured to the shaft 34, being attached to cause a rotation of that shaft by the water pressure entering the housing from the pipe 16 and leaving the housing by the pipe 18 as shown in FIG. 4, in conventional manner. The conventional brush 17 has bristles 51 extending from its circular head 37. An outer flexible removable shield 50 is provided around the exterior of the brush head 37. Suitable connection strips 52 are provided to hold the flexible hoses 16 and 18 together as a unit adjacent the water powered brush 17 as illustrated, for convenience of the operator in using the brush 17, by manually grasping of 16–18.

From the foregoing construction, it will be seen that my water powered brush can be used whenever the water flows through the main water line 10–11 to the discharge head S whenever desired, by a manual operation of the handle 15 of the first or manual pivoted crank valve 13 of the first off-chute T water flow line 12. By an opening of that first pivot crank valve 13 counter-clockwise, as illustrated in FIG. 1, to position the valve as there illustrated, that will cause a flow of the water through the pipes 12 and 16 and the water flow will thus operate the rotary water powered turbine brush 17, and all of the water will then return by the return flow pipe 18 and 19, through the exit offset pipe 19 by the water flow raising the spring valve 20 and the water will be fully discharged out of the head S without any diminishing of the flow of the water from its original source. On the other hand, should the operator not need to use the brush but desire to use the water straight out the discharge end S, then he will turn the manually operable pivot door valve crank 13–15 to cause that door 13 to pivot clockwise on its pivot 14, to position the door 13 to fully close the offset T pipe 12 as shown in FIG. 3, and thus the water will fully bypass that closed door 13 and will not enter the pipe 12–16 and will not operate the brush, but the water will flow completely out the head discharge S. It is to be noted in the latter condition of a closing of the pivoted valve 13 just explained and the passing of the water straight through 11, that the spring actuated valve 20, as heretofore explained, is fully closed by its spring, as illustrated in FIG. 3, due to the action of that spring tension and further due to its design and the water flow thereover by the water pressure assisting in that closing, so that there is no water then entering into the water powered brush through either of the offset pipes 16 and 18.

Thus, applicant has provided the method of providing in a water pressure flow line a water powered brush by the steps of taking the water pressure by an offstep flexible line from the main line to operate the brush and then returning the water to the main line, and having the offset line and its brush adapted for use adjacent to and with a water outlet from the main line. Further, with the brush being adapted for operational use only when desired, but not required to be used if not desired or needed on main line water flow.

Thus, while I have illustrated and explained a preferred embodiment of my invention with relation to a shower bath head, it is to be distinctly understood that many other uses could be made thereof within the spirit, teaching and intent of my invention. For example: My invention could be adapted for use as a dental brush appliance device, where there was a water main stream outlet, and where leading as an offset before that outlet there was a flexible water powered brush in a flexible offset line extension connection therefrom, adapted for use therewith as one combined dental element. In the cleaning brush industry, such as for household use or in the automobile washing industry, there could be my water powered offset flexible conduit remote from the outlet, having my water powered brush in the offset for use with the main stream but without taking water therefrom.

The use of my novel water powered brush in the flexible takeoff off-chute line of the main water line is operated according to the method consisting of the following steps: (a) Taking water power by a flexible U-shaped hose off-chute line from the main water power line for the purpose of operating the turbine of a rotary water brush and then returning all of the water from the turbine thereby to the main water power line; and (b) Directing all of the water in the main line by a continuation of the main water line to its outlet discharge point.

Having thus explained, illustrated and described my invention, it is to be understood that the teaching, spirit, intent, and scope thereof is to be limited only by the hereunto appended claims.

What I claim and desire to secure by Letters Patent is:

1. In combination, a water pressure driven rotary turbine cleaning brush operably mounted in a housing and connected for water pressure flow with a main water pressure flow line having a terminus and adapted for operation by the water flow of the main line by a water coupler flow first takeoff water line from the main water flow line before the main line terminus, said first take-off water line being connected by a coupler means to the brush housing to direct water pressure flow to operate the brush turbine, a second water coupler flow water line connecting the housing with the main water flow line by another coupler means and adapted to return all the water flow from the rotary turbine to the main line at a point on the main line between the first take-off line and the main line terminus, and a manually operable water valve in the main water flow line to direct the water pressure flow therefrom into the first take-off line to operate the rotary turbine by routing the water flow through the brush turbine and back into the main line by the second water flow line for discharge out the main line terminus.

2. A water operated rotary cleaning brush combination operated by a main water flow line and having a line terminus comprising a main water pressure flow line having two offset flow connections therefrom short of said terminus, a housing, a rotatable brush in the housing, a casing detachably connected to the housing and in which the brush is rotatably positioned, means in the housing rotatably mounting the brush, a turbine impeller positioned in the housing and carried by the brush, a first water tube connecting one offset flow connection to said housing for water supply flow operation of the turbine, a second water tube connection from the housing to the other offset flow connection for outlet of all the water supply flow from the turbine back to the main water flow line, and a manually operable valve means within the main water flow line over the first offset flow connection therefrom and operable for opening or closing said first offset connection flow therefrom.

3. A water operated rotary cleaning brush combination as in preceding claim 2, and defined further by said manually operable valve over the first offset flow connection when in open position causing the water flow in the main water flow line to be directed through the water turbine for operating the brush thereby.

4. A water operated rotary cleaning brush combination as set forth in preceding claim 2 and defined further by the definition of a spring actuated pivotal water flow shut-off valve positioned in the main water flow line over and across the other offset flow connection therefrom, said water flow valve being normally actuated by its spring to be closed over said other offset flow connection from the main line, but with its spring of insufficient tension to prevent water from the water turbine to discharge into the main line by raising said valve on its pivot against that spring tension.

5. The method of operating a water powered turbine appliance by water power of a main water line, comprising the steps of: taking off water pressure by a flexible offset water line from the main water line remote from the discharge end of the main line by an operable valve means within the main water line and operable for opening or closing the offset line to bypass the offset line and its said water powered brush when said valve means is in a closed position, mounting an operable water turbine brush in the line of the flexible offset line for operation thereof by the flow of all of the water therein, and directing the return of all of the water flow from the turbine by the offset line to return all of the water flow to the main line for ultimate discharge of all of the water flow out the discharge end of the main line after it has passed through said offset line and water powered turbine brush.

* * * * *